US006808403B2

(12) United States Patent
Morlesin

(10) Patent No.: US 6,808,403 B2
(45) Date of Patent: Oct. 26, 2004

(54) FLEXIBLE MEDIUM VOLTAGE INTERCONNECTION AND METHOD TO OBTAIN SAME

(75) Inventor: Roberto Morlesin, Vilvoorde (BE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 09/832,830

(22) Filed: Apr. 12, 2001

(65) Prior Publication Data

US 2001/0055906 A1 Dec. 27, 2001

(30) Foreign Application Priority Data

Apr. 13, 2000 (FK) ..... 00401045.0

(51) Int. Cl.[7] ..... H01R 13/53
(52) U.S. Cl. ..... 439/181; 439/161
(58) Field of Search ..... 439/181, 161, 439/593, 263, 88, 90, 921, 932, 839, 654

(56) References Cited

U.S. PATENT DOCUMENTS 3,034,090 A * 5/1962 Noschese ..... 339/61
3,708,610 A 1/1973 Kozel et al.
3,853,375 A 12/1974 McClain
3,937,995 A 2/1976 DeVito
4,889,303 A * 12/1989 Wolf ..... 248/160
5,037,332 A * 8/1991 Wilson ..... 439/608
5,062,808 A * 11/1991 Hosler, Sr. ..... 439/580
5,271,975 A * 12/1993 Solano ..... 428/34.9
5,435,740 A * 7/1995 Credeio et al. ..... 439/320
5,865,654 A * 2/1999 Shimirak et al. ..... 439/852
6,231,404 B1 * 5/2001 Lichy ..... 439/811
6,315,591 B2 * 11/2001 Oda et al. ..... 439/252

FOREIGN PATENT DOCUMENTS

EP 0 406 509 A1 1/1991
FR 2 741 484 A1 5/1997
WO WO 97/43698 11/1997

* cited by examiner

*Primary Examiner*—P. Austin Bradley
*Assistant Examiner*—Edwin A. Leon
(74) *Attorney, Agent, or Firm*—Sughrue Mion, PLLC

(57) ABSTRACT

A flexible medium voltage interconnection adapted to electrically interconnect receiving connectors of "bushings" of equipment stations. The interconnection comprises a conductive core including a metal conductor with, at each end thereof, an electrical connector adapted to mate the receiving connector of the bushing, and a flexible tube having at least an insulating layer of elastomeric material and covering the whole conductive core. The elastomeric material of the tube is preferably a synthetic terpolymer of ethylene, propylene and diene [EPDM] to increase the flexibility of the whole. In the method, the tube is expanded over the metal core of which the ends are foreseen with locking rings mating grooves of the tube in order to prevent a relative movement of the core with respect to the tube.

29 Claims, 5 Drawing Sheets

FLEXIBLE MEDIUM VOLTAGE INTERCONNECTION AND METHOD TO OBTAIN SAME

The present invention relates to a method to provide a medium voltage interconnection for realizing an electrical connection between a receiving connector of a first equipment station and a receiving connector of a second equipment station.

BACKGROUND OF THE INVENTION

Such an interconnection is generally known in the art. It is made of a metal conductor at the ends of which are mounted electrical connectors. The electrical connector mates with the receiving connector generally forming part of a "bushing" of an equipment station. The equipment station is typically a transformer or switchgear in transformation station and the properties of the connectors are therefore preferably standardized.

The electrical connector is molded in polyethylene material so as to form a massive conductive core enclosed within a screened insulating body. As a result, the interconnection is relatively rigid and, additionally, is not available in different relative short lengths, e.g. of about 30 cm.

A connector of this kind is described e.g. in FR-2 741 484. This document is directed to an electrical connector for connecting e.g. two cables, and comprising a conductive core including a metal conductor with at each end thereof, an electrical connector. It also comprises an elastic protective sleeve made of a layer of semiconductive or conductive rubber. This connector is pre-fabricated by molding a one-piece element.

OBJECTS AND SUMMARY OF THE INVENTION

An object of the present invention is to provide an interconnection of the above known type but of which the electrical connectors are relatively more flexible, and available in different lengths without any significant extra-cost.

According to the invention, this object is achieved by a method which comprises the steps of:

- providing an electrical connector mating said receiving connector at each end of a metal conductor, said metal conductor with its two connectors forming a conductive core,
- providing a flexible tube made of at least an insulating layer of elastomeric material and having the same length as said conductive core,
- expanding radially said flexible tube and sliding therein said conductive core, and
- releasing said flexible tube over said conductive core.

In this way, the molding process is replaced by an extrusion process. As a result, the conductive core is composed of a flexible conductor connected to two electrical connectors, whole enclosed within an elastic tube or sleeve to define connection insulated interfaces to mating the receiving connectors of the equipments. For many applications, flexible interconnections are more adequate due to the flexibility of material and dimensions.

The method of the present invention preferably comprises the steps of providing said electrical connector with a substantially conical shape of which the base has a diameter relatively larger than the diameter of said metal conductor, and of connecting said base to an end of said metal conductor.

The so obtained interconnection best matches the standard bushings.

More particularly, the present method further comprises the step of engaging one end of said flexible tube into an inner side of a conical bushing means made of insulating material and provided with said receiving connector so as to bring the electrical connector of the conductive core into contact with said receiving connector and said insulating layer of said flexible tube into contact with said inner side of said bushing means.

In a preferred embodiment, said method comprises the steps of providing said flexible tube with, coaxially starting from the center:

- a first semiconductive layer,
- an insulating layer made of elastomeric material, and
- a second semiconductive layer.

Such an extruded 3-layer tube gives the best results with respect to flexibility and insulation properties.

Also in a preferred embodiment, said method further comprises the steps of:

- providing an external locking ring onto at least one electrical connector of said conductive core, and
- providing into said flexible tube at least one internal ring groove for receiving the locking ring of said electrical connectors when the tube is released over said conductive core.

The flexible tube or sleeve is then locked onto the electrical connectors or end-pieces of the conductive core to prevent any relative movement. The grooves may also be used to hold slidable outer clamps to mechanically clamp each electrical connector and possibly to achieve the external screening continuity between the interconnection and the mating parts.

The present invention also relates to a medium voltage interconnection obtained by the method of the invention and adapted to electrically connect a receiving connector of a first equipment station and a receiving connector of a second equipment station.

This medium voltage interconnection comprises a conductive core including a metal conductor with, at each end thereof, an electrical connector adapted to mate said receiving connector, and a flexible tube having at least an insulating layer made of elastomeric material and covering the whole conductive core.

In a characterizing embodiment of the present invention, said elastomeric material is a synthetic terpolymer of ethylene, propylene and diene [EPDM].

In a variant, said elastomeric material is a silicone.

These materials are preferred for their good flexibility and insulation qualities.

Further characterizing embodiments of the present method and medium voltage interconnection are mentioned in the appended claims.

It is to be noticed that the term 'comprising', used in the claims, should not be interpreted as being limitative to the means listed thereafter. Thus, the scope of the expression 'a device comprising means A and B' should not be limited to devices consisting only of components A and B. It means that with respect to the present invention, the only relevant components of the device are A and B.

Similarly, it is to be noticed that the term 'coupled', also used in the claims, should not be interpreted as being limitative to direct connections only. Thus, the scope of the expression 'a device A coupled to a device B' should not be limited to devices or systems wherein an output of device A is directly connected to an input of device B. It means that there exists a path between an output of A and an input of B which may be a path including other devices or means.

BRIEF DESCRIPTION OF THE DRAWINGS

The above and other objects and features of the invention will become more apparent and the invention itself will be best understood by referring to the following description of an embodiment taken in conjunction with the accompanying drawings wherein.

MORE DETAILED DESCRIPTION

Figures 2A, 2B:
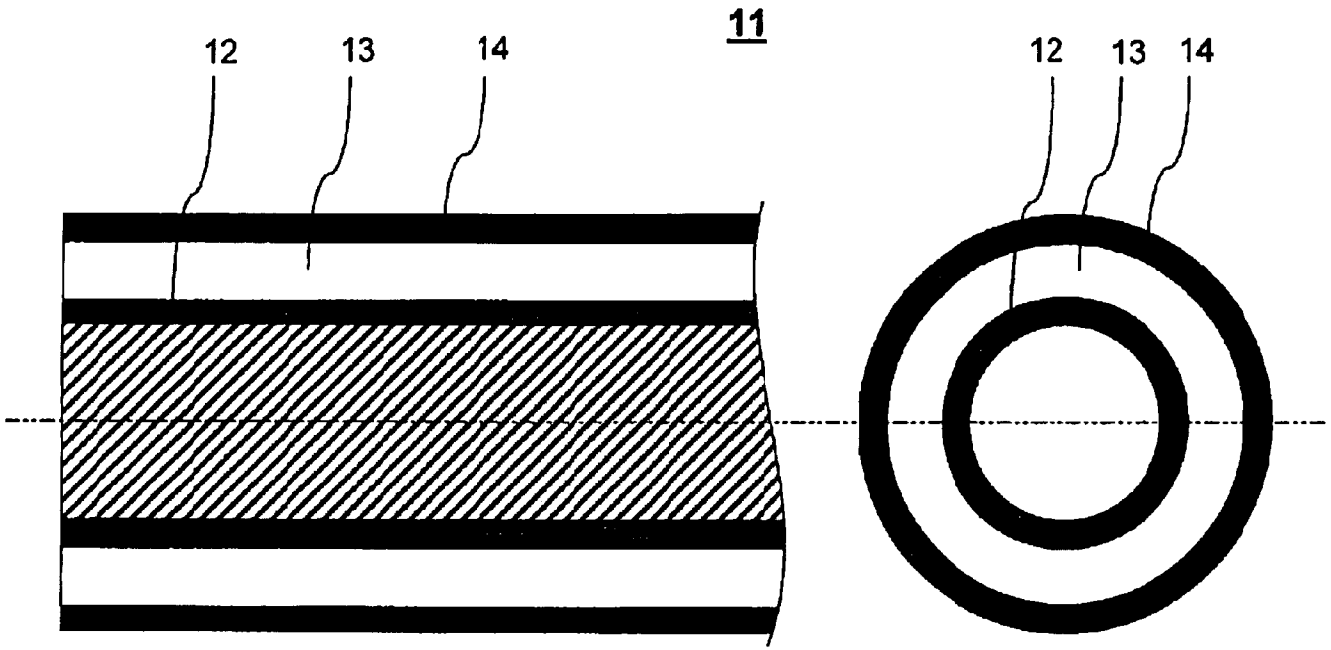
FIGS. 2*a* and 2*b* represent the left end and a sectional view of a flexible tube 5 used in the interconnection of the invention.

It is to be noted that all the views, except FIG. 2*b*, are cross-sectional views along the longitudinal axis, and that although only the left end of the medium voltage interconnection is shown in the FIGS. 2*a*, 3, 4 and 5, the right end of this interconnection is identical thereto. Moreover, the different views are not all drawn at the same scale.

The flexible interconnection of the present invention is intended to be used for electrically connecting medium voltage electrical devices located in distinct equipment stations. Such an electrical device is for instance a switchgear or a transformer operating at voltages above 1 kVolt and enclosed in an equipment station that is a tank or a cubical. The equipment station is filled with an insulated medium that is oil fluid or gas, generally pressurized sulfur hexafluoride [SF6]. Each terminal of the electrical device is connected to a so-called "bushing well" or "bushing" hermetically mounted inside a hole of a wall of the equipment station.

The bushing well is an insulating molded hollow cone provided with a metallic rod interconnecting a connector at the top of the outer side of the cone with a receiving connector at the inner side of this cone, inside the well. The receiving connector meets the requirements of ANSI/IEEE Standard 386-1977 as is the case of the known bushing "K16O1PCC/K16O1PCC-R Clampable Apparatus Bushing Well with Gasket" of AMERACE™ LTD (10 Esna Park Drive Markham, Ontario, Canada L3R 1E1/Nov. 1, 1983). It is to be noted that bushing wells with other dimensions but still matching the present interconnection may also be used.

One side of the bushing, generally the outer side of the cone, is immersed in the insulated medium of the equipment station and electrically connected to the electrical device, whilst the inner side of the cone is in the ambient air and provided with the receiving connector designed to receive one end of the flexible interconnection.

In order to interconnect two bushings, the flexible interconnection comprises a conductive core surrounded by a flexible tube that will be explained in detail below.

Figure 1:
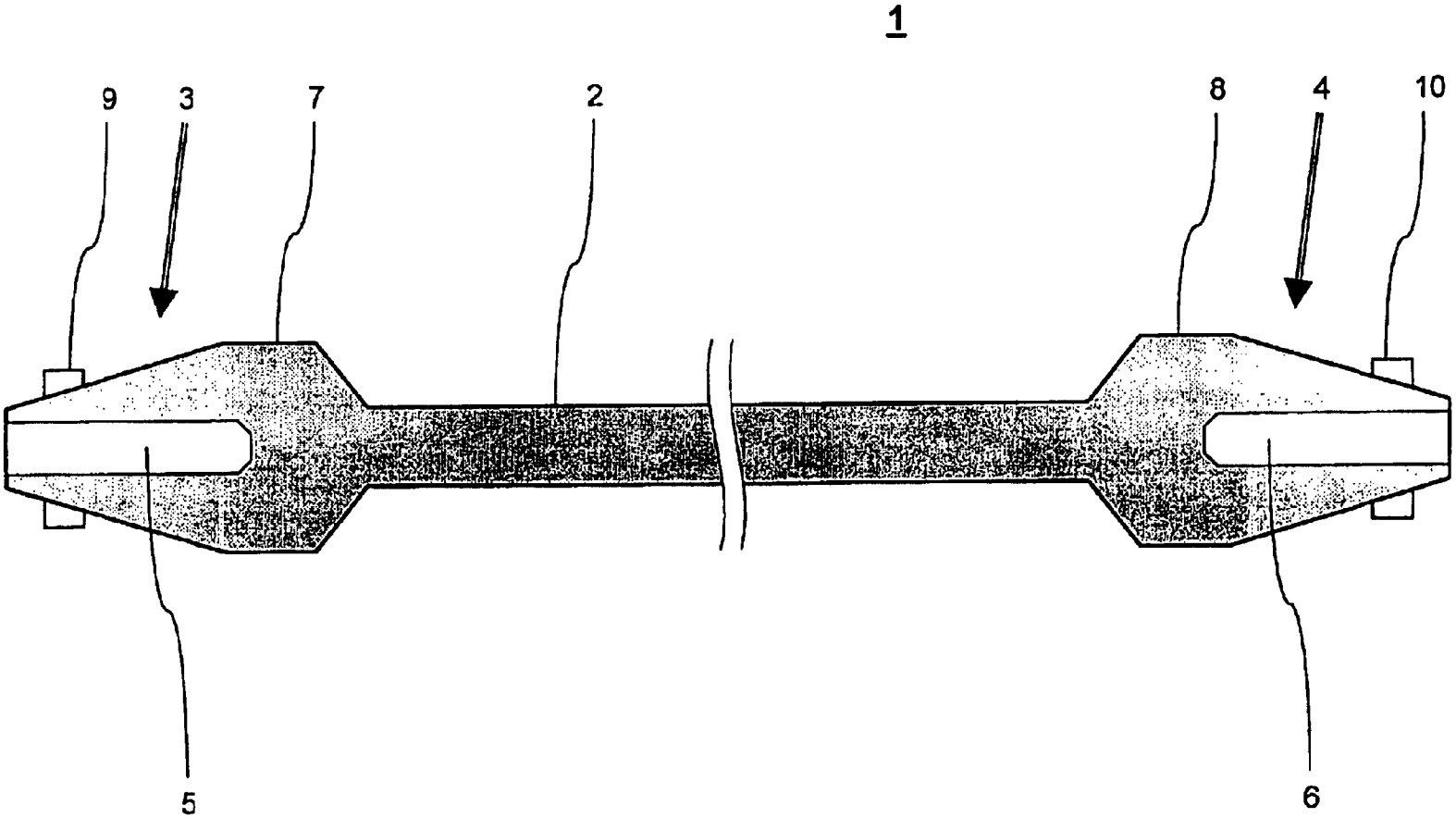
FIG. 1 represents a longitudinal view of a conductive core 1 of a medium voltage interconnection according to the invention.

The conductive core, generally indicated by 1 in FIG. 1, is made of a metal flexible conductor 2 provided at each end with an electrical connector, indicated by arrows 3 and 4. Each connector 3/4 is adapted for mating the receiving connector of the bushing.

The electrical connector 3/4 has a central blind hole 5/6 for connecting to a respective receiving connector of the bushing and has a conical shape of which the base 7/8 is respectively connected to an end of the metal flexible conductor 2. This base 7/8 has a diameter that is larger than the diameter of the metal conductor 2. The electrical connector 3/4 is further provided with an external locking ring 9/10 mating in an internal ring groove of the flexible tube.

Figure 3:
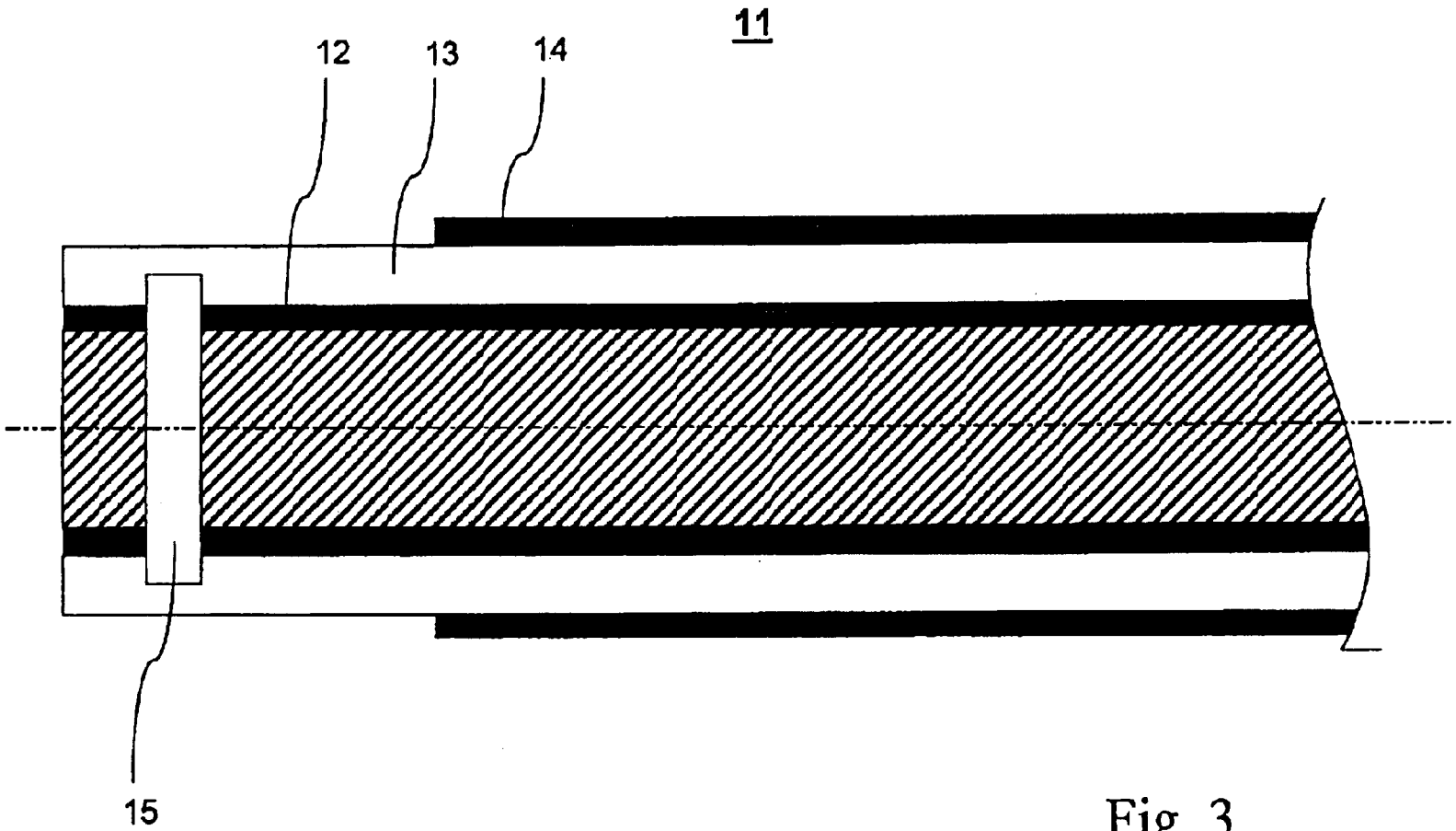
FIG. 3 represents the left end of the flexible tube 5 of FIG. 2 prepared to receive the conductive core 1 of FIG. 1.

The conductive core 1 is covered, protected and insulated by a flexible tube, generally indicated by 11 in the FIGS. 2*a*, 2*b* and 3, and preferably made of up to three layers of material.

The flexible tube 11 is a molded or extruded tube made of a first semiconductive layer 12 (at the inside), an insulating layer 13 made of elastomeric material, and a second semiconductive layer 14 (at the outside). In order to improve the elasticity of the flexible tube 11, the elastomeric material of the insulating layer 13 is preferably a synthetic terpolymer of ethylene, propylene and diene [EPDM]. Additionally, this EPDM may be recycled and is thus friendly for the environment. The tube 11 preferably has the same length as the conductive core 1.

The flexible tube 11 is then prepared for receiving the conductive core 1, as shown at FIG. 3. Therefore, each end of the second semiconductive layer 14 is removed at a certain distance up to the insulation material 13. At the same time, an internal ring groove 15 is provided at each end in the first semiconductive layer 12 and partially in the insulating layer 13 of the flexible tube 11. The flexible tube 11 is then radially expanded and the conductive core 1 is slid therein.

Figure 4:
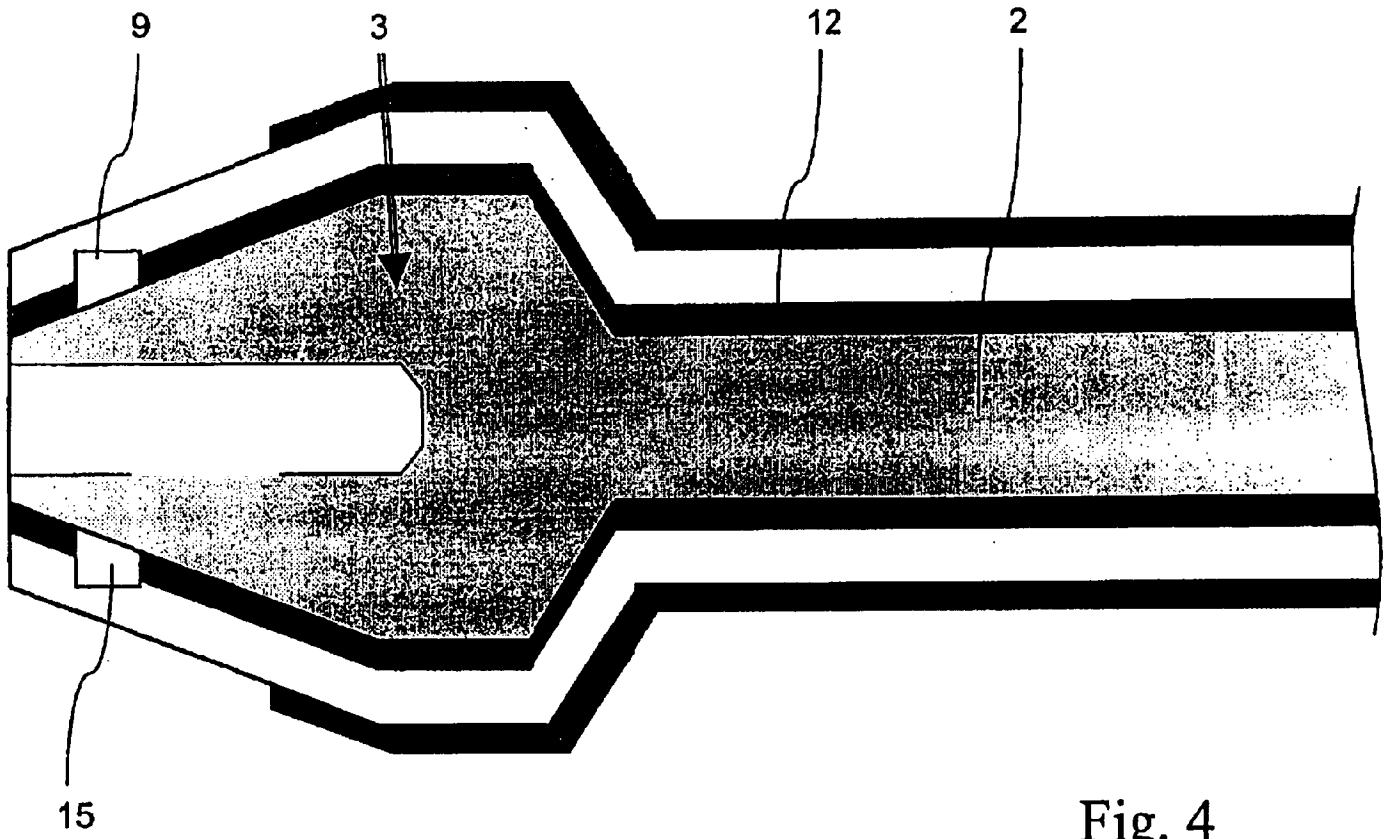
FIG. 4 shows the left end of the whole assembly of the medium voltage interconnection of the invention, including the conductive core 1 of FIG. 1 and the flexible tube 5 of FIG. 3.

Afterwards, the flexible tube is released over the conductive core 1 in order to obtain a resulting medium voltage interconnection as shown at FIG. 4. The flexible tube 11 has now taken the shape of the underlying conductive core 1 and the latter is prevented to move therein owing to the mating external locking ring 9/10 of the conductive core and the internal ring groove 15 of the tube. The first semiconductive layer 12 of the tube is in contact with the metal flexible conductor 2 and the connectors 3/4.

Figure 5:
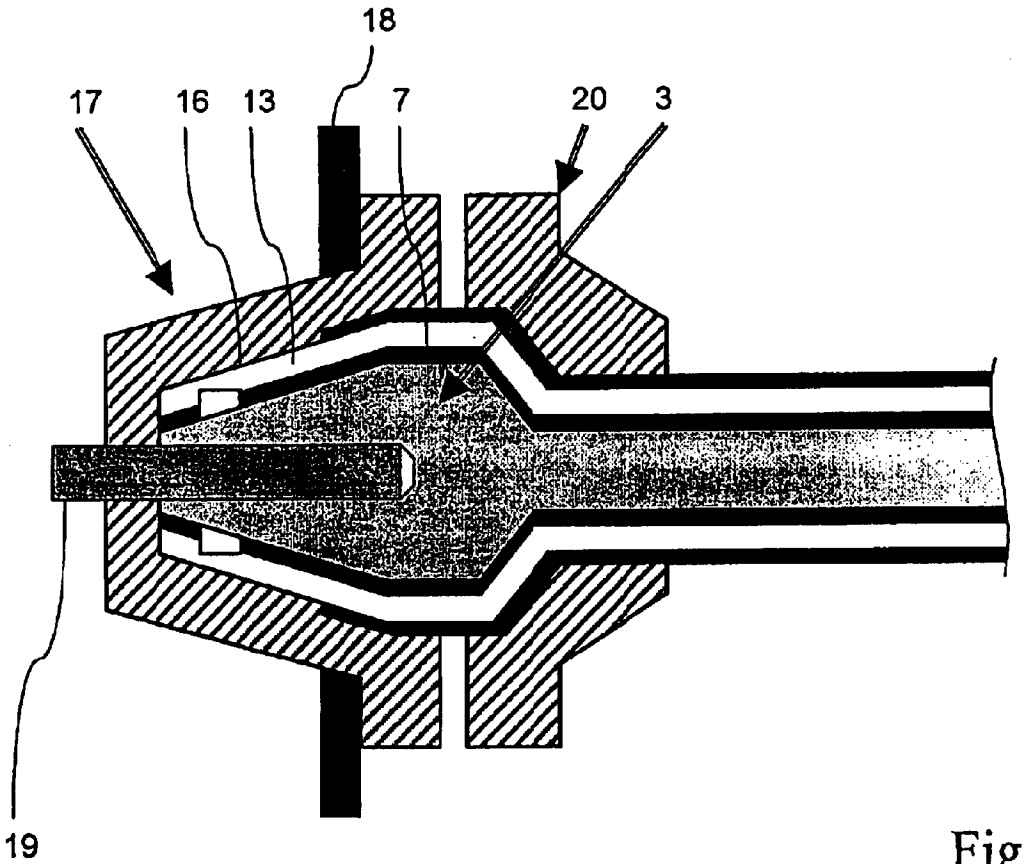
FIG. 5 represents the left end of the medium voltage interconnection engaged in a bushing of an equipment station.

As shown at FIG. 5, each end of the so obtained interconnection may then be engaged into an inner side 16 of a conical bushing, generally indicated by an arrow 17, as described above, and mounted in a hole of a wall 18. The receiving connector 19 of the bushing 17 is so brought into contact with the electrical connector 3 of the conductive core via its hole 5, whilst the insulating layer 13 of the interconnection is brought into contact with the inner side 16 of the bushing. In order to give the necessary pressure on the expanded tube to ensure a contact with a tight fit between mating parts of the bushing and the interconnection, a fixing ring, indicated by arrow 20, is provided over the conductive core at each end thereof. On the left side of the interconnection, the fixing ring 20 abuts against the base 7 of the conical electrical connector 3 covered by the flexible tube and is mechanically fixed (not shown) to the bushing 17.

As an option, a metal flexible protection (not shown) can be mounted on the outside of the tube to take the short-circuit currents.

It is finally to be noted that the insulating layer of the bushing device may also be a molded elastomeric material, preferably a synthetic terpolymer of ethylene, propylene and diene [EPDM] as for the insulating layer 13 of the flexible tube 11.

While the principles of the invention have been described above in connection with specific apparatus, it is to be clearly understood that this description is made only by way of example and not as a limitation on the scope of the invention, as defined in the appended claims.

What is claimed is:

1. Method to provide a medium voltage interconnection for realizing an electrical connection between a receiving connector of a first equipment station and a receiving connector of a second equipment station, said method comprising the steps of:

providing an electrical connector mating said receiving connector at each end of a metal conductor, said metal conductor with its two connectors forming a conductive core, providing a flexible tube with at least, coaxially starting from the center:

a first semiconductive layer, an insulating layer of elastomeric material, expanding radially said flexible tube and sliding therein said conductive core, including said two connectors inside said expanded flexible tube, and releasing said flexible tube over said conductive core to form an interconnection assembly.

2. Method according to claim 1, further comprising the steps of:

providing said electrical connector with a substantially conical shape having a base with a diameter relatively larger than a diameter of said metal conductor, and connecting said base to an end of said metal conductor.

3. Method according to claim 1, further comprising the steps of:

providing an external locking ring onto at least one electrical connector of said conductive core, and providing into said flexible tube at least one internal ring groove for receiving the locking ring of said electrical connector when the tube is released over said conductive core.

4. Method according to claim 1, wherein said flexible tube has the same length as said conductive core.

5. Method according to claim 1, further comprising the step of engaging one end of said flexible tube into an inner side of a conical bushing means made of insulating material and provided with said receiving connector so as to bring the electrical connector of the conductive core into contact with said receiving connector and said insulating layer of said flexible tube into contact with said inner side of said bushing means.

6. Method according to claim 5, comprising the steps of providing said flexible tube with, coaxially starting from the center:

said first semiconductive layer, said insulating layer made of elastomeric material, and a second semiconductive layer, and further comprising the step of removing partially said second semiconductive layer at the end of said flexible tube prior to the step of engaging said end of said flexible tube into said bushing means.

7. Method according to claim 1, comprising the steps of providing said flexible tube with, coaxially starting from the center:

said first semiconductive layer, said insulating layer made of elastomeric material, and a second semiconductive layer.

8. Method according to claim 7, comprising the steps of:

providing a ring groove into said first semiconductive layer, and providing a ring groove partially into said insulating layer.

9. Method to provide a medium voltage interconnection according to claim 1, further comprising the step of passing a medium voltage through said interconnection assembly.

10. Method to provide a medium voltage interconnection according to claim 9, wherein said medium voltage passing through said interconnection assembly is greater than 1 kV.

11. A medium voltage interconnection, adapted to electrically connect a receiving connector of a first equipment station and a receiving connector of a second equipment station, said interconnection comprising a conductive core including a metal conductor with, at each end thereof, an electrical connector adapted to mate said receiving connector, and a flexible tube having, coaxially staring from the center, a first semiconductive layer, and an insulating layer made of elastomeric material and covering the whole conductive core; and wherein said flexible tube is placed over said conductive core by radially expanding said flexible tube, relatively sliding said conductive cone inside said flexible tube, and releasing said flexible tube over said conductive core.

12. Medium voltage interconnection according to claim 11, wherein said elastomeric material is a synthetic terpolymer of ethylene, propylene and diene [EPDM].

13. Medium voltage interconnection according to claim 11, wherein said elastomeric material is a silicone.

14. Medium voltage interconnection according to claim 11, wherein said electrical connector has a substantially conical shape having a base connected to said metal conductor, said base having a diameter relatively larger than a diameter of said metal conductor.

15. Medium voltage interconnection according to claim 11, wherein said flexible tube is a multi-layer tube comprising, coaxially starting from the center, a said first semiconductive layer, said insulating layer made of elastomeric material, and a second semiconductive layer.

16. Medium voltage interconnection according to claim 11, wherein the electrical connector of said conductive core is provided with an external locking ring mating in an internal ring groove in the insulating layer of said flexible tube.

17. Medium voltage interconnection according to claim 14, wherein one end of said flexible tube is adapted to be engaged into an inner side of a conical bushing means made of insulating material and provided with said receiving connector, the electrical connector of said conductive core being adapted to be brought into electrical contact with said receiving connector, and said insulating layer of said flexible tube being adapted to be brought into contact with said inner side of said bushing means.

18. Medium voltage interconnection according to claim 17, wherein said interconnection is provided with a fixing ring located over said conductive core and over said flexible tube, said fixing ring being adapted to abut against the base of the conical electrical connector and to be fixed to said bushing means.

19. A method of making an interconnection, comprising the steps of:

providing a conductive core having a first electrical connector at one end of the conductive core and a second electrical connector at the other end of the conductive core;

providing a flexible tube having, coaxially starting from the center, a first semiconductive layer and an insulating layer of elastomeric material;

expanding said flexible tube and relatively sliding said conductive core, including at least said first electrical connector, inside said expanded flexible tube; and releasing said flexible tube over said conductive core to form an interconnection assembly.

20. The method of making an interconnection according to claim 19, further comprising the step of electrically interconnecting a first equipment station to a second equipment station with said interconnection assembly.

21. The method of making an interconnection according to claim 20, further comprising the step of passing a medium voltage through said interconnection assembly.

22. The method of making an interconnection according to claim 20, further comprising the step of engaging one end of said flexible tube into an inner side of a bushing made of insulating material that is provided with said first equipment station so as to bring said first electrical connector into contact with a receiving connector of said first equipment station and said insulating layer of said flexible tube into contact with said inner side of said bushing.

23. The method of making an interconnection according to claim 19, wherein said first and second connectors have a substantially conical shape, and wherein said flexible tube is expanded and released over at least said first connector having the substantially conical shape.

24. The method of making an interconnection according to claim 23, wherein each of said first and second connectors axially expands from the respective end of said conductive core towards a center of said conductive core between said first and second connectors.

25. A method of providing a medium voltage interconnection for realizing an electrical connection between a receiving connector of a first equipment station and a receiving connector of a second equipment station, said method comprising the steps of:

providing an electrical connector mating said receiving connector at each end of a metal conductor, said metal conductor with its two connectors forming a conductive core;

providing a flexible tube made of at least an insulating layer of elastomeric material;

expanding radially said flexible tube and sliding therein said conductive core, including said two connectors inside said expanded flexible tube; and releasing said flexible tube over said conductive core to form an interconnection assembly; and further comprising the step of engaging one end of said flexible tube into an inner side of a conical bushing means made of insulating material and provided with said receiving connector so as to bring the electrical connector of the conductive core into contact with said receiving connector and said insulating layer of said flexible tube into contact with said inner side of said bushing means.

26. A method of providing a medium voltage interconnection for realizing an electrical connection between a receiving connector of a first equipment station and a receiving connector of a second equipment station, said method comprising the steps of:

providing an electrical connector mating said receiving connector at each end of a metal conductor, said metal conductor with its two connectors forming a conductive core;

providing a flexible tube made of at least an insulating layer of elastomeric material;

expanding radially said flexible tube and sliding therein said conductive core, including said two connectors inside said expanded flexible tube; and releasing said flexible tube over said conductive core to form an interconnection assembly; and further comprising the steps of:

providing an external locking ring onto at least one electrical connector of said conductive core, and providing into said flexible tube at least one internal ring groove for receiving the locking ring of said electrical connector when the tube is released over said conductive core.

27. A medium voltage interconnection, adapted to electrically connect a receiving connector of a first equipment station and a receiving connector of a second equipment station, said interconnection comprising a conductive core including a metal conductor with, at each end thereof, an electrical connector adapted to mate said receiving connector, and a flexible tube having at least an insulating layer made of elastomeric material and covering the whole conductive core; and wherein said flexible tube is placed over said conductive core by radially expanding said flexible tube, relatively sliding said conductive cone inside said flexible tube, and releasing said flexible tube over said conductive core; and wherein said electrical connector has a substantially conical shape having a base connected to said metal conductor, said base having a diameter relatively larger than a diameter of said metal conductor; and wherein one end of said flexible tube is adapted to be engaged into an inner side of a conical bushing means made of insulating material and provided with said receiving connector, the electrical connector of said conductive core being adapted to be brought into electrical contact with said receiving connector, and said insulating layer of said flexible tube being adapted to be brought into contact with said inner side of said bushing means.

28. A medium voltage interconnection, adapted to electrically connect a receiving connector of a first equipment station and a receiving connector of a second equipment station, said interconnection comprising a conductive core including a metal conductor with, at each end thereof, an electrical connector adapted to mate said receiving connector, and a flexible tube having at least an insulating layer made of elastomeric material and covering the whole conductive core; and wherein said flexible tube is placed over said conductive core by radially expanding said flexible tube, relatively sliding said conductive cone inside said flexible tube, and releasing said flexible tube over said conductive core; and wherein the electrical connector of said conductive core is provided with an external locking ring mating in an internal ring groove in the insulating layer of said flexible tube.

29. A method of making an interconnection, comprising the steps of:

providing a conductive core having a first electrical connector at one end of the conductive core and a second electrical connector at the other end of the conductive core;

providing a flexible tube having an insulating layer of elastomeric material;

expanding said flexible tube and relatively sliding said conductive core, including at least said first electrical connector, inside said expanded flexible tube; and releasing said flexible tube over said conductive core to form an interconnection assembly; and further comprising the steps of:

electrically interconnecting a first equipment station to a second equipment station with said interconnection assembly, and engaging one end of said flexible tube into an inner side of a bushing made of insulating material that is provided with said first equipment station so as to bring said first electrical connector into contact with a receiving connector of said first equipment station and said insulating layer of said flexible tube into contact with said inner side of said bushing.

* * * * *